United States Patent [19]

Hooker

[11] 4,200,291

[45] Apr. 29, 1980

[54] DEVICE WITH HOLD AND ADVANCE FEATURE FOR THE REELS OF A GAME MACHINE

[75] Inventor: Donald E. Hooker, Wilmette, Ill.

[73] Assignee: Bally Manufacturing Corporation, Chicago, Ill.

[21] Appl. No.: 783,755

[22] Filed: Apr. 1, 1977

[51] Int. Cl.[2] ..... A63F 5/04

[52] U.S. Cl. ..... 273/143 R

[58] Field of Search ..... 273/143 R, 143 A, 143 B, 273/143 C, 143 D, 143 E, 138 A, 141 A

[56] References Cited

U.S. PATENT DOCUMENTS

| | | | |
|---|---|---|---|
| 2,527,661 | 10/1950 | Stack | 273/143 R UX |
| 2,545,644 | 3/1951 | Benton et al. | 273/143 C |
| 3,034,790 | 5/1962 | Breitenstein | 273/138 A X |
| 3,129,004 | 4/1964 | Ritzler | 273/143 R |
| 3,733,075 | 5/1973 | Hooker et al. | 273/143 R X |

FOREIGN PATENT DOCUMENTS

| | | | |
|---|---|---|---|
| 1233081 | 5/1971 | United Kingdom | 273/143 R |
| 1242298 | 8/1971 | United Kingdom | 273/143 R |
| 1292712 | 10/1972 | United Kingdom | 273/138 A |

*Primary Examiner*—Richard C. Pinkham
*Assistant Examiner*—Arnold W. Kramer
*Attorney, Agent, or Firm*—Hill, Van Santen, Steadman, Chiara & Simpson

[57] ABSTRACT

A game machine which incorporates apparatus for holding or advancing the reels such that the player may have the option, before spinning the reels, of designating whether a particular reel will spin, or remain stationary, or advance a specified number of index positions.

2 Claims, 4 Drawing Figures

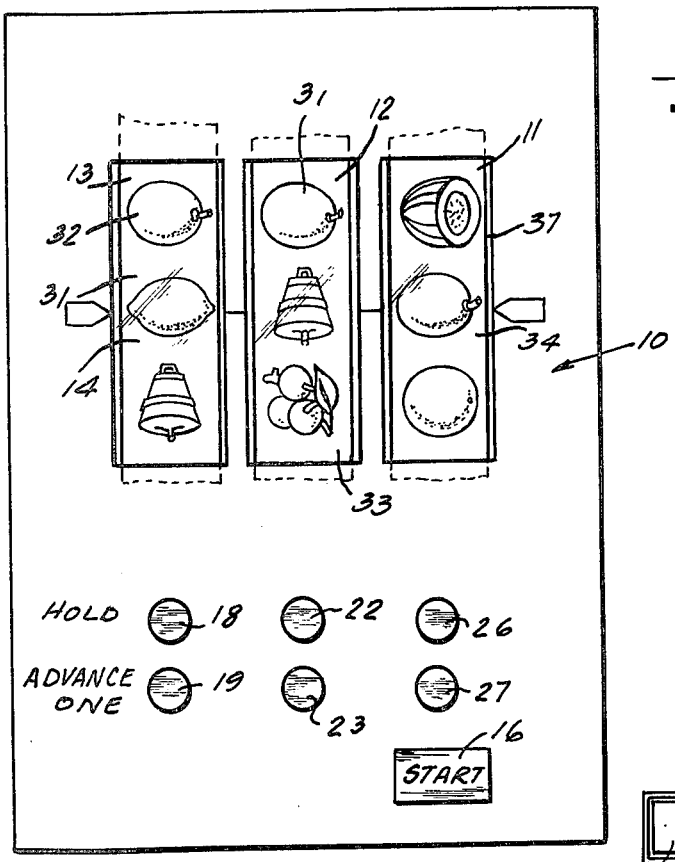
Fig. 1
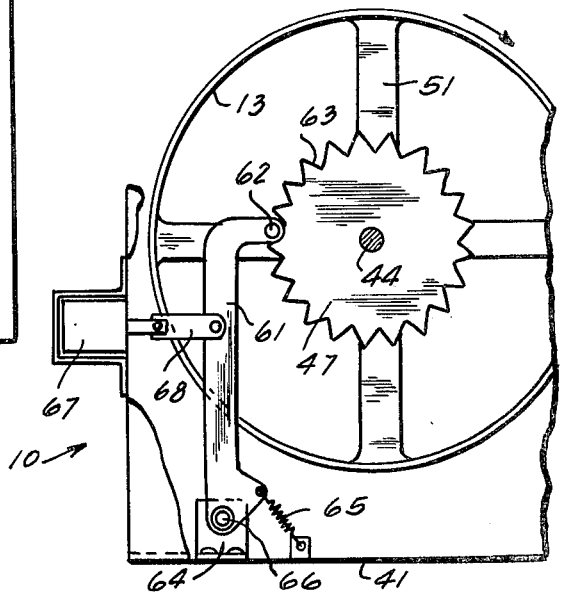
Fig. 3
Fig. 2
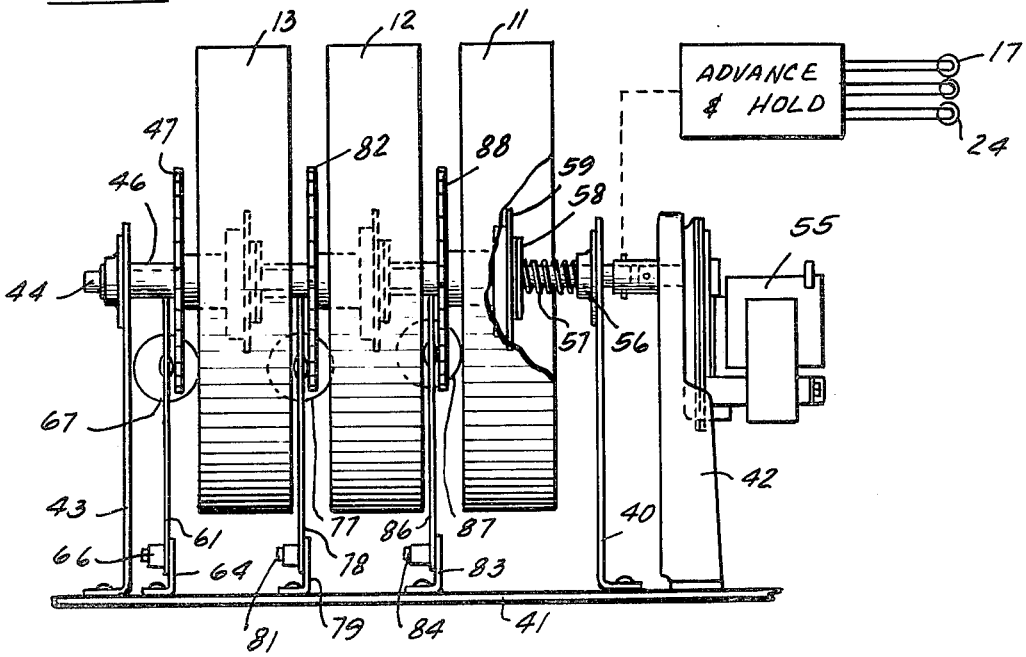

DEVICE WITH HOLD AND ADVANCE FEATURE FOR THE REELS OF A GAME MACHINE

BACKGROUND OF THE INVENTION

1. Field of the Invention

The present invention relates in general to a game machine with hold and advance features.

2. Description of the Prior Art

Game machines are known in which a plurality of reels are driven and stoped in a random manner so as to indicate various combinations of winners. Holding any one of the reels is also known.

SUMMARY OF THE INVENTION

The present invention relates to a novel game machine which has besides the well known hold feature, a controlled advance feature which is programmed into the machine by the player before spinning the reel. In this machine, the player has the option of programming the machine before the reel spin is initiated by means of switches for other inputs so that any selected reel will (1) spin when spin cycle is initiated or, (2) remain stationary or, (3) advance a prescribed number of simple steps.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

BRIEF DESCRIPTION OF THE DRAWINGS

FIG. 1 is a plan view of the game machine of the invention;

FIG. 2 illustrates the driving mechanism for the reels;

FIG. 3 illustrates the locking detent mechanism; and

DESCRIPTION OF THE PREFERRED EMBODIMENTS

Figure 4:
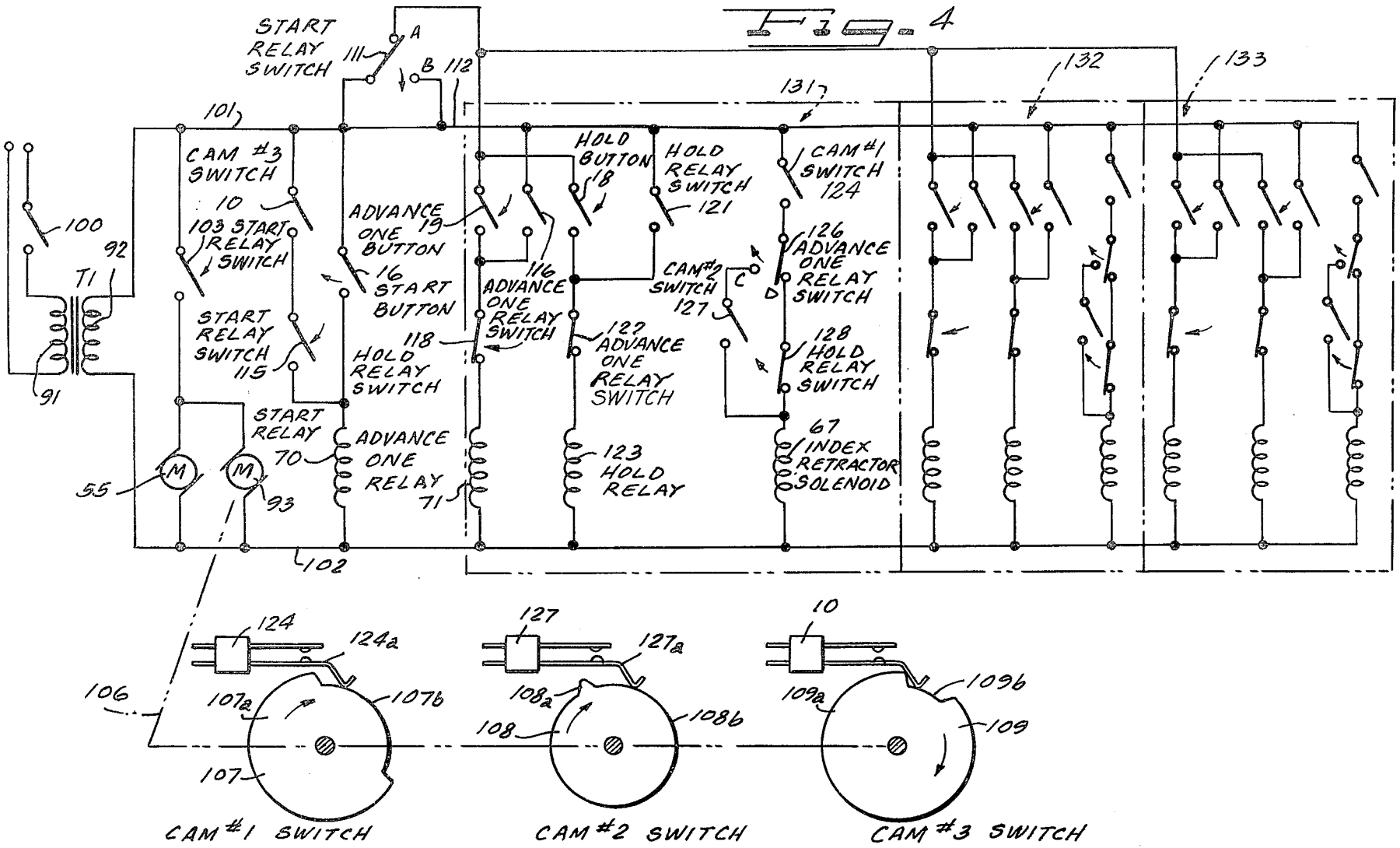
FIG. 4 is an electrical schematic view illustrating the novel features of the invention.

FIG. 1 illustrates the game machine 10 of the invention in which three reels 11, 12 and 13 are mounted on a suitable support shaft and carry symbols which are visible through a window 14. In the particular example illustrated in FIG. 1, the reels 11, 12 and 13 have stopped so as to show symbols 34, 33 and 31, respectively, on the center horizontal line in the window display. Certain combinations of symbols on the center line are specified as winners. The symbols directly above this line are also visible. An advance of one stop on the index wheel of any one of the reels will advance the symbol directly above the center line down to the center line. A hold button 18 and an advance button 19 for controlling the reel 13 are situated below reel 13. A hold button 22 and an advance one button 23 are mounted beneath reel 12. A hold button 26 and an advance button 27 are mounted beneath reel 11. To obtain a hold or advance one for any one of the reels, the appropriate hold or advance one button must be pressed before the start button is pressed.

FIGS. 2 and 3 illustrate internal construction of the reel driving and indexing mechanism. A base plate 41 carries a pair of stand-offs 43 and 40 upon which a drive shaft 44 is rotatably supported. A motor support 42 supports a motor 55 which is coupled to drive the shaft 44. Each of the reels 11, 12 and 13 is coupled to the drive shaft 44 with a clutch mechansim so that the reels will be driven unless they are held against rotation when the shaft 44 is being rotated. For this purpose, for reel 11, for example, a disc 59 is attached to the reel 11 and a disc 58 is slidably connected to a spring 57 and connected to the shaft 44 such that the disc 58 rotates with the shaft. Locking detents 61, 78 and 86 are respectively provided for the reels 13, 12 and 11 and as shown in FIGS. 2 and 3, for example, the locking detent 61 is pivotally attached by shaft 66 to a stand-off 64 connected to the base plate 41 and is spring biased by a spring 65 such that its engaging pawl 62 engages the teeth 63 of an index wheel 47 which is connected to the reel 13. A solenoid 67 has an actuating link 68 which is connected to the locking detent 61 such that when the solenoid 67 is energized, the engaging portion 62 is moved out of contact with the teeth 63 of the index wheel 47 so that the reel 13 can be driven by the motor 55. A solenoid 77 controls the position of locking detent 78 for reel 12 and a solenoid 87 controls the locking detent 86 for the reel 11. Reels 12 and 11 have index wheel 82 and 88 corresponding to index wheel 47.

FIG. 4 is an electrical schematic of the control system of the invention. Power is applied to the primary 91 of the transformer T1 through an enable switch 100 which enables the circuitry for one play cycle. The secondary 92 of transformer T1 is connected to lines 101 and 102. The reel driving motor 55 and a motor 93 which rotates cams #1, #2 and #3 are connected in parallel and energized by switch 103, which closes when start relay 70 is energized. Start relay 70 is energized when start button switch 16 is closed.

As soon as motor 93 starts to rotate #3, switch 10 is closed. Switch 10 is connected in series with start relay switch 115, which is closed when relay 70 is energized. Relay 70 thus will still be energized after start button switch 16 is opened, and remains energized until cam #3 makes a complete revolution and opens switch 10. Cams #1 and #2 also make a complete revolution, since all three cams are driven in unison by motor 93.

The circuit enclosed in area 131 is the control circuit for programming reel #13 prior to actuating the start button. Identical circuits are shown in areas 132 and 133 for programming reels 12 and 11. Since the circuits in 131, 132 and 133 are identical, only the circuit in 131 will be explained in detail.

Before the reel spin operation has been initiated, start relay 70 is not energized, and start relay switch 111 is in position A. The hold button or the advance one button may now be pressed. If the advance one button 19 is pressed, the advance one relay 71 will be energized and held in by its switch 116, and its switch 122 will be open and prevent the hold relay 123 from being pulled in by the hold button 18. If the hold button 18 is pressed first, the hold relay 123 will be energized and held in by its switch 121 and its switch 118 will be open and prevent the advance one relay 71 from being energized. It is evident that either the hold relay 123 or the advance one relay 71 may be locked in, but not both.

When the start button 16 is pressed, the reel driver motor 55 and the cam motor 93 start to run. Cam #3 holds in the start relay 70 through switch 10. After the cams have rotated further, cam #1 closes switch 124 and cam #2 closes switch 127 for a short time interval. If the advance one relay is energized, switch 126 will be at position C and switch 127 when it closes will energize the index retract solenoid 67. Cam #2 is so shaped that the time interval during which switch 127 closes solenoid 67 just long enough for the index wheel 47 to advance one notch, and therefore the next symbol in sequence on the reel will stop at the center line.

If the hold relay 123 was energized before the start button 16 was pressed, the advance one relay switch 126 would be at position D, and the hold relay switch 128 would be open, so the index retractor solenoid would not operate and the reel would not rotate. This is known as holding the reel.

If neither the hold relay 123 or the advance relay 71 are energized, switch 126 will be in position D and hold relay switch 128 will be closed, so the index retractor solenoid will be energized during the length of time dictated by cam #1 switch 124. Reel 13 will rotate, or spin, during this time interval.

Although an advance one function is described above, by using a longer time interval for closing switch 127, or by any other technical method of advancing a reel, the advance one function may be replaced with an advance two, or any other specified degree of advance.

It is evident that by controlling each reel with the above described circuit, the player may, before starting the game operation, so program any reel as to let it spin, hold it stationary, or move it a predetermined angle.

Although the invention has been described with respect to preferred embodiments, it is not to be so limited, as changes and modifications may be made which are within the full intended scope as defined by the appended claims.

I claim as my invention:

1. A player actuated game machine having a housing with a plurality of rotatable reels each with more than one indicia visible through a window having a play cycle wherein the machine is first enabled by the player, after which the player can be choice selectively hold or advance by one indicia position one or more of said reels, after which said player can start the machine and each of said reels which have been selected to be held will remain stationary, each of said reels which have been selected to advance one indicia will advance one indica, and the remaining reels will spin freely to end the play cycle, the improvement comprising, player actuated means for holding at least one of said reels, player actuated means for advancing one indicia at least one of said reels, reel drive means coupled to said reels, and player actuated start means for causing said reels to be held, advanced by one indicia or to spin freely.

2. A player actuated game machine having a housing with a plurality of rotatable reels each with more than one indicia visible through a window having a play cycle wherein the machine is first enabled by the player, after which the player can by choice selectively choose to advance by one indicia position one or more of said reels during the play cycle after which said player can start the machine and each of said reels which have been selected to advance one indicia will advance one indicia and the remaining reels will spin freely to end the play cycle, the improvement comprising player actuated means for advancing by one indicia at least one of said reels in cooperation with reel drive means coupled to said reels, and player actuated start means for causing said reels to be advanced by one indicia or to spin freely.

* * * * *